US007014570B2

(12) United States Patent
Evans et al.

(10) Patent No.: US 7,014,570 B2
(45) **Date of Patent: *Mar. 21, 2006**

(54) GOLF CLUB STRIKING PLATE WITH VARIABLE THICKNESS

(75) Inventors: D. Clayton Evans, San Marcos, CA (US); J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/906,796

(22) Filed: Mar. 7, 2005

(65) Prior Publication Data

US 2005/0137029 A1 Jun. 23, 2005

Related U.S. Application Data

(63) Continuation of application No. 10/605,291, filed on Sep. 19, 2003, which is a continuation of application No. 10/063,927, filed on May 24, 2002, now Pat. No. 6,623,377, which is a continuation of application No. 09/606,809, filed on Jun. 28, 2000, now Pat. No. 6,398,666, which is a continuation-in-part of application No. 09/481,167, filed on Jan. 12, 2000, now Pat. No. 6,368,234, which is a continuation-in-part of application No. 09/431,982, filed on Nov. 1, 1999, now Pat. No. 6,354,962.

(51) Int. Cl.
*A63B 53/04* (2006.01)

(52) U.S. Cl. ..... 473/329; 473/345; 473/342; 473/349

(58) Field of Classification Search ..... 473/324–350, 473/290–291
See application file for complete search history.

(56) References Cited

U.S. PATENT DOCUMENTS

| | | | | |
|---|---|---|---|---|
| 5,482,279 | A * | 1/1996 | Antonious | 473/327 |
| 5,797,807 | A * | 8/1998 | Moore | 473/345 |
| 6,319,150 | B1 * | 11/2001 | Werner et al. | 473/349 |
| 6,354,962 | B1 * | 3/2002 | Galloway et al. | 473/342 |
| 6,368,234 | B1 * | 4/2002 | Galloway | 473/349 |
| 6,398,666 | B1 * | 6/2002 | Evans et al. | 473/345 |
| 6,623,377 | B1 * | 9/2003 | Evans et al. | 473/342 |
| 6,863,626 | B1 * | 3/2005 | Evans et al. | 473/342 |

* cited by examiner

*Primary Examiner*—Sebastiano Passaniti
(74) *Attorney, Agent, or Firm*—Michael A. Catania; Elaine H. Lo

(57) ABSTRACT

A golf club head having a striking plate with regions of varying thickness is disclosed herein. A central region has a first thickness range that is thicker than the thickness range of any of the other regions. The thickness of the regions decreases outward from the center. The striking plate may be used on a fairway wood-type golf club head or a driver-type golf club head. The striking plate is preferably composed of steel or titanium.

14 Claims, 6 Drawing Sheets

GOLF CLUB STRIKING PLATE WITH VARIABLE THICKNESS

CROSS REFERENCES TO RELATED APPLICATIONS

The present application is a continuation of U.S. patent application Ser. No. 10/605,291, which was filed on Sep. 19, 2003, which is a continuation of U.S. patent application Ser. No. 10/063,927, which was filed on May 24, 2002, now U.S. Pat. No. 6,623,377, issued Sep. 23, 2003, which is a continuation of U.S. patent application Ser. No. 09/606,809, which was filed on Jun. 28, 2000, now U.S. Pat. No. 6,398,666, issued Jun. 4, 2002, which is a continuation-in-part of U.S. patent application Ser. No. 09/481,167, which was filed on Jan. 12, 2000, now U.S. Pat. No. 6,368,234, issued Apr. 9, 2002, which is a continuation-in-part of U.S. patent application Ser. No. 09/431,982, which was filed on Nov. 1, 1999, now U.S. Pat. No. 6,354,962 issued Mar. 12, 2002.

BACKGROUND OF THE INVENTION

1. Field of the Invention

The present invention relates to a golf club striking plate. More specifically, the present invention relates to a golf ball striking plate having a variable thickness.

2. Description of the Related Art

Present golf clubs have repositioned weight in order to lower the center of gravity for better performance. This repositioning of weight has for the most part attempted to thin the crown and striking plate of the golf club while precisely placing the weight in the sole of the golf club. However, thinning the striking plate too much may lead to failure of the golf club.

When the striking plate impacts a golf ball during a swing, large impact forces (in excess of 2000 pounds) are produced thereby loading the striking plate. In the relatively thin striking plates of hollow metal woods and cavity-back irons, these forces tend to produce large internal stresses in the striking plate. These internal stresses often cause catastrophic material cracking which leads to failure of the club head.

Computational and experimental studies on hollow metal woods and cavity-backed irons have demonstrated that such catastrophic material cracking most often occurs at impact points on the striking plate. These impact points require added strength to prevent club head failure.

In designing golf club heads, the striking plate must be structurally adequate to withstand large repeated forces such as those associated with impacting a golf ball at high speeds. Such structural adequacy may be achieved by increasing the striking plate stiffness so that the stress levels are below the critical stress levels of the material used in the striking plate. Typically, for metal woods, the striking plates are stiffened by uniformly increasing the thickness of the striking plate and/or by adding one or more ribs to the interior surface of the striking plate.

Uniformly increasing the thickness of the striking plate portion typically requires the addition of large amounts of material to adequately reduce the stress sufficient to prevent impact and/or fatigue cracking. However, the addition of such a large amount of material to a striking plate generally adversely affects the performance of the golf club.

One of the first patents to disclose variable face thickness was U.S. Pat. No. 5,318,300 to Schmidt et al., for a Metal Wood Golf Club With Variable Faceplate Thickness which was filed on Nov. 2, 1992. Schmidt et al discloses thickening the faceplate to prevent cracking.

A further disclosure of variable face thickness is disclosed in U.S. Pat. No. 5,830,084 to Kosmatka for a Contoured Golf Club Face which was filed on Oct. 23, 1996. Kosmatka addresses contouring the face to thicken certain regions while thinning other regions depending on the stress load experienced by such regions. Kosmatka also discloses a method for designing a face plate according to measured stress levels experienced during impact with a golf ball. Kosmatka, U.S. Pat. No. 5,971,868 for a Contoured Back Surface Of Golf Club Face, filed on Nov. 18, 1997, discloses similar contouring for an iron.

A more recent disclosure is Noble et al., U.S. Pat. No. 5,954,596, for a Golf Club Head With Reinforced Front Wall, which was filed on Dec. 4, 1997. Noble et al. discloses a face plate with the thickness portion at the geometric center, and gradually decreasing toward the top and bottom, and the sole and heel. The top and bottom ends along a line through geometric center have the same thickness, and the heel and sole ends along a line through geometric center have the same thickness.

Other references make partial disclosure of varying face thickness. One example is FIG. 8 of U.S. Pat. No. 5,505,453, which illustrates an interior surface of a face with a bulging center and decreasing thickness towards the heel and sole ends, similar to Noble et al. Another example is FIGS. 4C and 4D of U.S. Pat. No. 5,346,216, which discloses a bulging center that decreases in thickness toward the heel and sole ends, and the top and bottom end of the face, similar to Noble et al. However, the prior art has failed to design a striking plate or face plate that varies the thickness according to predicted golf ball impact points on the striking plate.

BRIEF SUMMARY OF THE INVENTION

The present invention is directed at a striking plate for a golf club head that is contoured according to the probability of impact with a golf ball in order to lessen the overall thickness of the striking plate, and thus lessen the weight of the golf club head. Further, the striking plate has regions of varying thickness that allow for more compliance during impact with a golf ball.

One aspect of the present invention is a golf club head having a body with a crown, a sole, a heel end, a toe end and a striking plate. The striking plate includes a central region, a transition region and a first peripheral region. The central region has a first thickness and occupies 5% to 15% of the exterior surface of a core face area. The transition region encompasses the central region and occupies 35 to 50% of the exterior surface of a core face area. The first peripheral region encompasses the transition region and occupies 40% to 55% of the exterior surface of the core face area. The first peripheral region has a thickness less than the first thickness. The transition region has a thickness that transitions from the first thickness to the second thickness.

Another aspect of the present invention is a striking plate for a golf club head. The striking plate includes a central region, a transition region, a first peripheral region and a second peripheral region. The central region has a first thickness in the range of 0.090 inch to 0.145 inch and occupies 5% to 15% of the exterior surface of a core face area. The transition region encompasses the central region and occupies 35 to 50% of the exterior surface of a core face area. The first peripheral region encompasses the transition region and occupies 40% to 55% of the exterior surface of the core face area. The first peripheral region has a second thickness less than the first thickness and is in the range of 0.050 inch to 0.105 inch. The transition region has a thickness that transitions from the first thickness to the second thickness. The second peripheral region encompasses the first peripheral region and has a third thickness that is in the range of 0.010 inch to 0.085 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
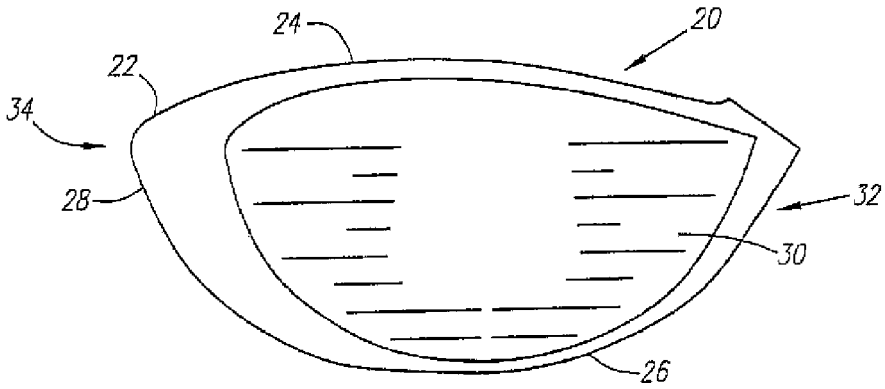
FIG. 1 is a front plan view of a golf club head with the striking plate of the present invention.

As shown in FIGS. 1–8, a golf club head is generally designated 20. The golf club head 20 has a body 22 with a crown 24, a sole 26, a ribbon 28 and a striking plate 30. The striking plate 30 generally extends from a heel end 32 to a toe end 34 of the front of the golf club head 20. The body 22 preferably has an internal hosel 36 for receiving the tip end of a shaft, not shown, through an aperture 38. The golf club head has a body 22 that is preferably composed of a metal material such as titanium, titanium alloy, stainless steel, or the like, and is most preferably composed of a forged titanium material. The body 22 preferably has a large volume, most preferably greater than 300 cubic centimeters, and is most preferably 350 cubic centimeters. The body 22 preferably weighs no more than 215 grams, and most preferably weighs between 180 and 205 grams. The body 22 has a hollow interior 23.

The striking plate 30 is partitioned into a plurality of regions 40, 42, 44 and 46, defined by lines 41, 43, 45 and 47, each having a different thickness or different thickness range. The exterior surface 53 of the striking plate is substantially smooth for impact with a golf ball, while the interior surface 55 of the striking plate varies in thickness creating a non-planar surface that is contoured according to impact probabilities as described in further detail below. The striking plate 30 is unitary in construction, and may or may not be composed of the same material of the body 22. The term unitary when used in conjunction with the striking plate 30 means that the striking plate 30 is a single piece and does not have additions to the interior surface 55 such as ribs or weighting members. A central region 40, defined by dashed line 41, has a base thickness that is preferably the greatest thickness of the regions 40, 42, 44 and 46. The base thickness ranges from 0.200 inch to 0.060 inch, preferably from 0.150 inch to 0.075 inch, and is most preferably within the range of 0.145 inch to 0.090 inch. A transition region 42 has a thickness that ranges between the thickness of the central region 40 and a first peripheral region 44, preferably ranges from 0.150 inch to 0.090 inch, and most preferably ranges from 0.140 inch to 0.080 inch. The first peripheral region 44 has a thickness that ranges from 0.110 inch to 0.040 inch, preferably ranges from 0.105 inch to 0.050 inch, and most preferably ranges from 0.100 inch to 0.075 inch. A second peripheral region 46 preferably is the thinnest region of the striking plate regions 40, 42, 44 and 46. The second peripheral region 46 has a thickness that ranges from 0.085 inch to 0.010 inch, preferably ranges from 0.080 inch to 0.045 inch, and most preferably ranges from 0.075 inch to 0.050 inch.

Figure 2:
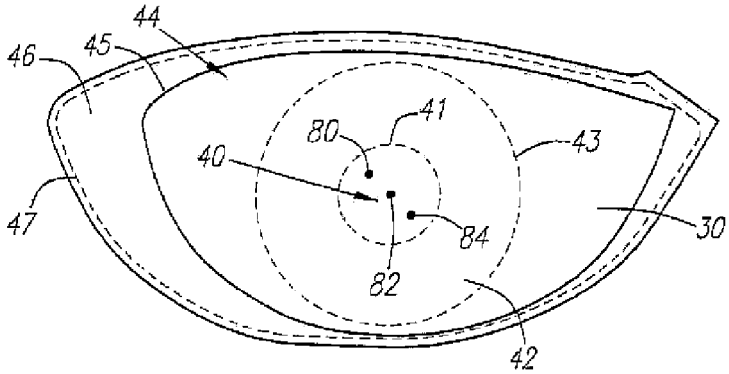
FIG. 2 is a front plan view of the striking plate of FIG. 1 showing the variable face thickness.

In a preferred embodiment, as shown in FIG. 2, the central region has a thickness range of 0.145 inch to 0.090 inch, the transition region 42 has a thickness range of 0.140 inch to 0.080 inch, the first peripheral region 44 has a thickness range of 0.105 inch to 0.090 inch, and the second peripheral region 46 has a thickness range of 0.075 inch to 0.050 inch.

Preferably, as shown in FIG. 2, the central region 40 is 5% to 15% of the surface area of the core face 49 of the striking plate 30. The core face 49 is defined as the central region 40, the transition region 42 and the first peripheral region 44. The core face area of the striking plate 30 has an area between 4.80 square inches and 5.50 square inches, preferably between 5.10 square inches and 5.40 square inches, and most preferably 5.38 square inches. The transition region 42 is preferably 35% to 50% of the surface area of the core face 49, and the first peripheral region 44 is preferably 40% to 55% of the surface area of the core face 49. In a preferred embodiment, the central region is 8.8% of the surface area of the core face 49, the transition region is 42.2% of the surface area of the core face 49, and the first peripheral region 44 is 50% of the surface area of the core face 49.

Figure 7:
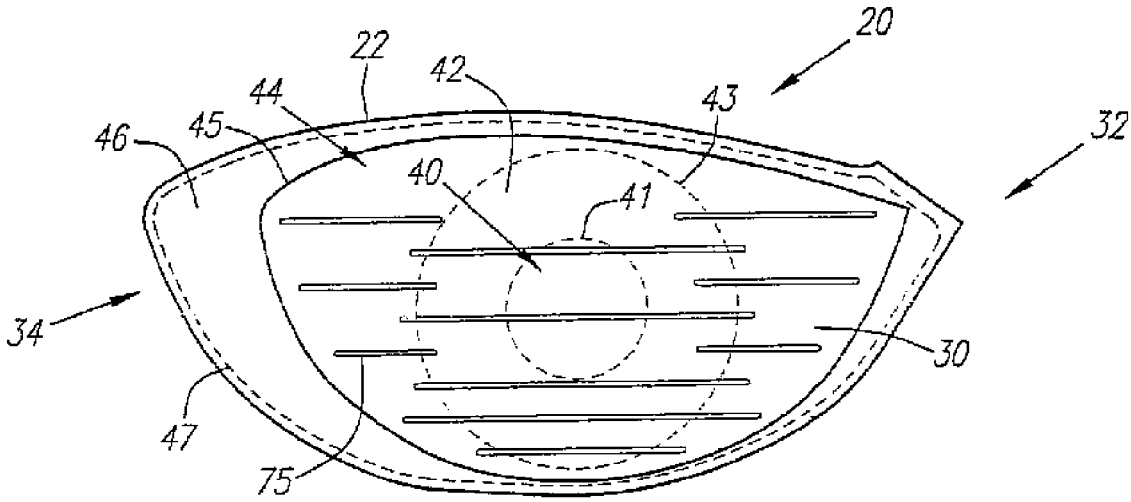
FIG. 7 is a front plan view of a fairway wood golf club head of the present invention with the variable thickness superimposed thereon.
Figure 8:
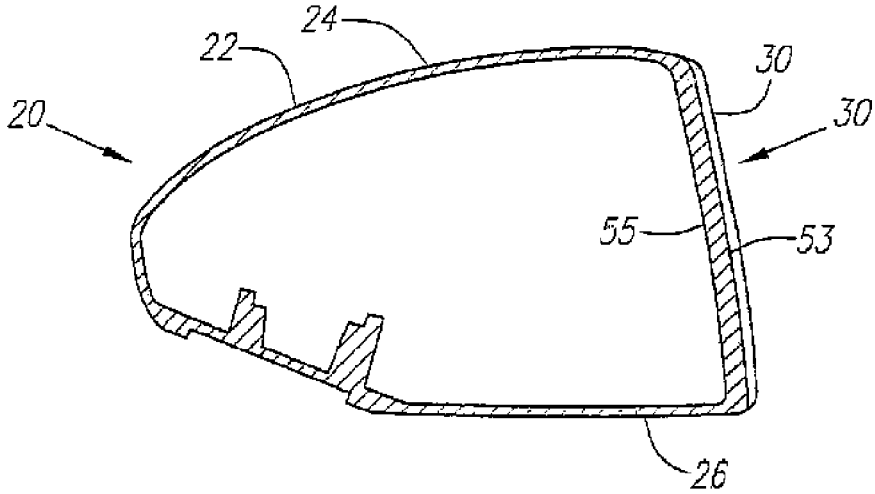
FIG. 8 is a cross-sectional view along lines 8—8 of FIG. 5.

FIG. 7 illustrates an alternative embodiment of the present invention for a fairway wood golf club head 20. In this embodiment, the central region has a thickness range of 0.135 inch to 0.125 inch, the transition region 42 has a thickness range of 0.130 inch to 0.090 inch, the first peripheral region 44 has a thickness range of 0.095 inch to 0.085 inch, and the second peripheral region 46 has a thickness range of 0.075 inch to 0.045 inch.

Table One sets forth the thickness ranges of the central region 40, the first peripheral region 44 and the second peripheral region 46 for preferred embodiments for drivers (lofts 7 degrees through 12 degrees) and fairway woods (2 wood through 9 wood).

TABLE ONE

| | Striking Plate Thickness | | |
|---|---|---|---|
| Club | Second Peripheral Region | First Peripheral Region | Center Region |
| 07° Driver | .050 ± .005 | .100 ± .005 | .140 ± .005 |
| 08° Driver | .050 ± .005 | .100 ± .005 | .140 ± .005 |
| 09° Driver | .050 ± .005 | .100 ± .005 | .140 ± .005 |
| 10° Driver | .050 ± .005 | .100 ± .005 | .140 ± .005 |
| 11° Driver | .050 ± .005 | .100 ± .005 | .140 ± .005 |
| 12° Driver | .050 ± .005 | .100 ± .005 | .140 ± .005 |
| 2 Wood | .050 ± .005 | .100 ± .005 | .140 ± .005 |
| 3 Wood | .055 ± .005 | .090 ± .005 | .130 ± .005 |
| Strong 3 | .060.005 | .090 ± .005 | .130 ± .005 |
| 4 Wood | .060 ± .005 | .085 ± .005 | .125 ± .005 |
| Strong 4 | .065 ± .005 | .090 ± .005 | .130 ± .005 |
| 5 Wood | .065 ± .005 | .085 ± .005 | .125 ± .005 |
| 7 Wood | .070 ± .005 | .085 ± .005 | .125 ± .005 |
| 9 Wood | .075 ± .005 | .085 ± .005 | .125 ± .005 |

Figure 2A:
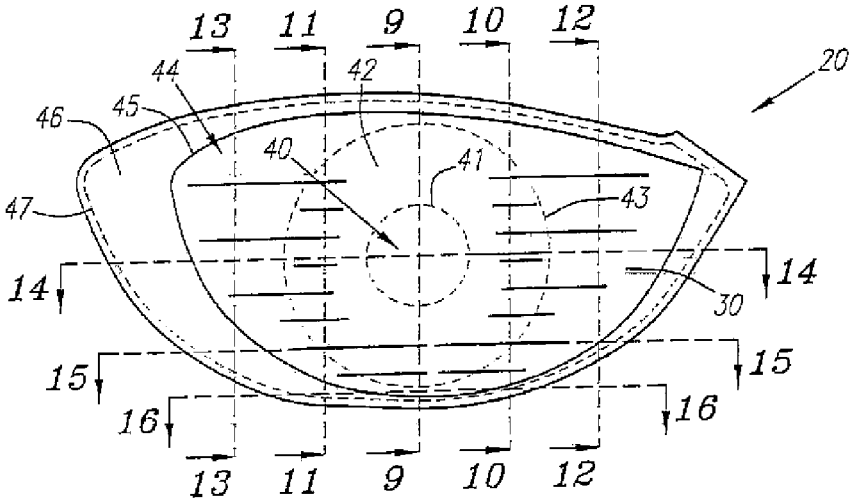
FIG. 2A is a front plan view of the golf club head of FIG. 1 with the variable face thickness pattern superimposed thereon.
Figure 3:
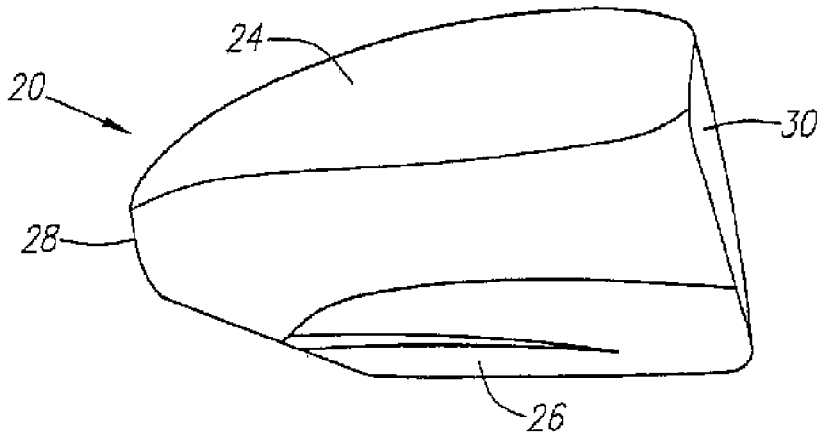
FIG. 3 is a toe side view of the golf club head of FIG. 1.
Figure 4:
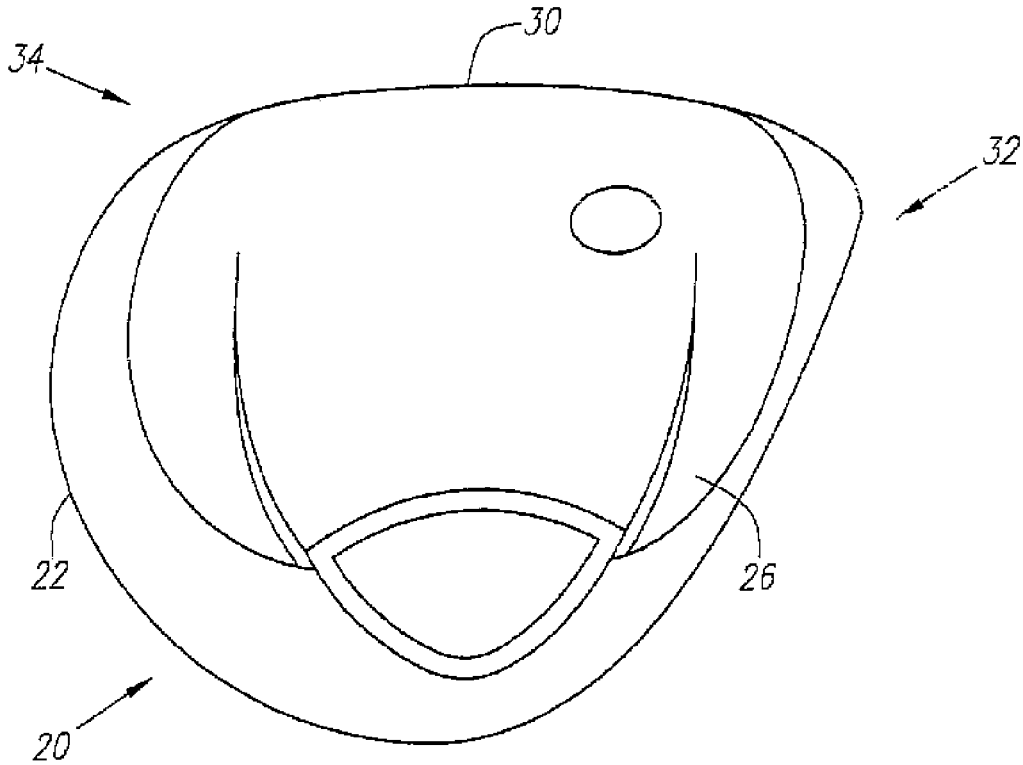
FIG. 4 is a bottom plan view of the golf club head of FIG. 1.
Figure 5:
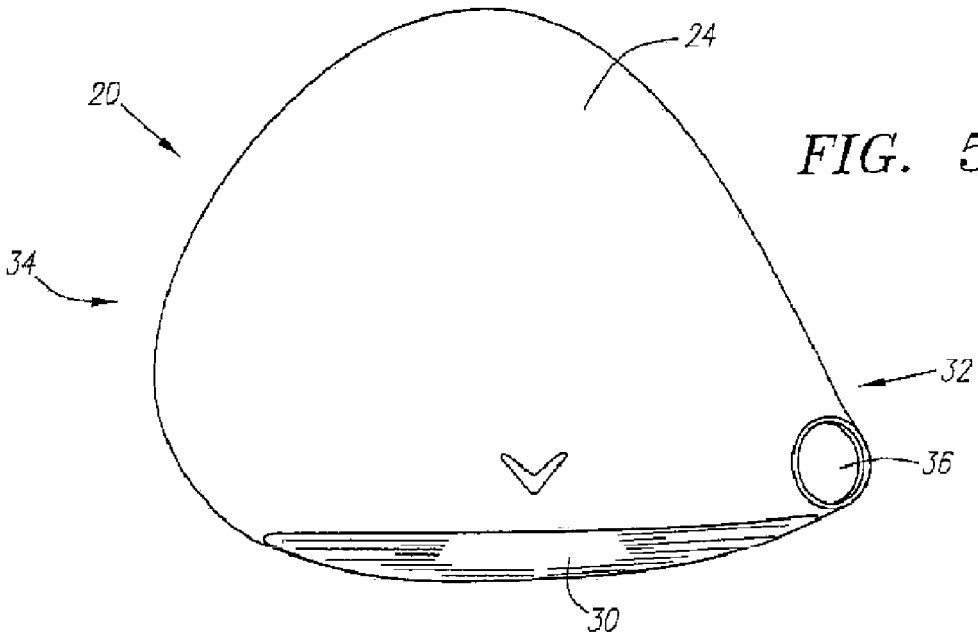
FIG. 5 is a top plan view of the golf club head of FIG. 1.
Figure 6:
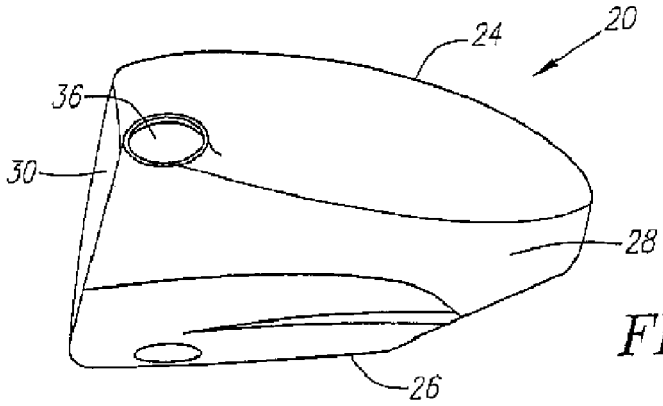
FIG. 6 is a heel side view of the golf club head of FIG. 1.
Figure 9:
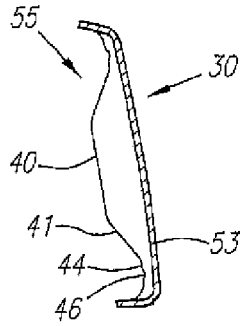
FIG. 9 is a cross-sectional view along lines 9—9 of FIG. 2A.
Figure 10:
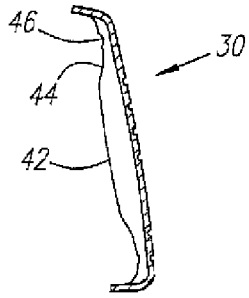
FIG. 10 is a cross-sectional view along lines 10—10 of FIG. 2A.
Figure 11:
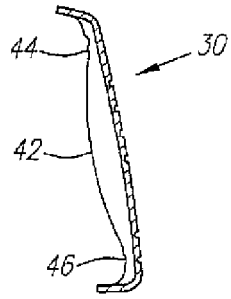
FIG. 11 is a cross-sectional view along lines 11—11 of FIG. 2A.
Figure 12:
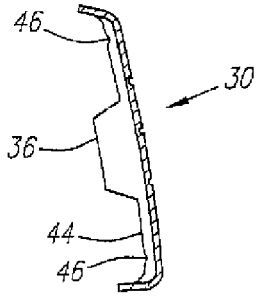
FIG. 12 is a cross-sectional view along lines 12—12 of FIG. 2A.
Figure 13:
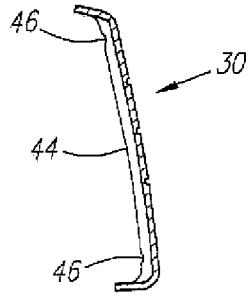
FIG. 13 is a cross-sectional view along lines 13—13 of FIG. 2A.

Cross-sections of the striking plate 30, taken from FIG. 2A, are illustrated in FIGS. 9–16. FIG. 9 illustrates a vertical cross-section of the mid-section of the striking plate 30 with the central region 40, the transition region 42, the first peripheral region 44 and the second peripheral region 46 on the contoured interior surface 55 as opposed to the relatively smooth, albeit scorelines, of the exterior surface 55 of the striking plate 30. FIGS. 10 and 11 illustrate vertical cross-sections that are adjacent both sides of the mid-section, and which only includes the transition region 42, the first peripheral region 44 and the second peripheral region 46. FIG. 12 illustrates a vertical cross-section on the heel end 32 of the striking plate 30 that has a wall of the internal hosel 36 integrated therewith in a preferred embodiment. FIG. 12 otherwise shows the first peripheral region 44 and the second peripheral region 46. Although the wall of the internal hosel 36 is shown as integrated with the striking plate 30, alternative embodiments have the internal hosel off-set from the interior surface 55 of the striking plate 30. FIG. 13 illustrates a vertical cross-section of the toe end 34 of the striking plate 30, which only includes the first peripheral region 44 and the second peripheral region 46.

Figure 14:
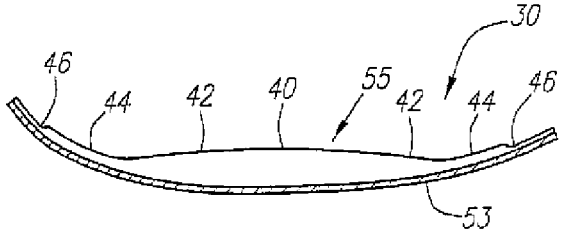
FIG. 14 is a cross-sectional view along lines 14—14 of FIG. 2A.
Figure 15:
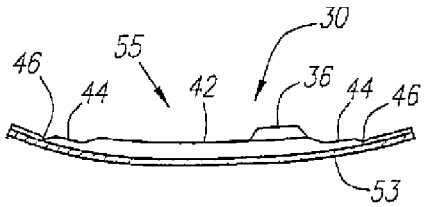
FIG. 15 is a cross-sectional view along lines 15—15 of FIG. 2A.
Figure 16:
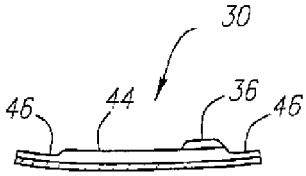
FIG. 16 is a cross-sectional view along lines 16—16 of FIG. 2A.

FIG. 14 illustrates a horizontal cross-section of the horizontal mid-section of the striking plate 30, which shows the central region 40, the transition region 42, the first peripheral region 44, the second peripheral region 46, and the wall of the internal hosel 36. FIG. 15 illustrates a horizontal cross-section below the horizontal mid-section of the striking plate 30, which only includes the transition region 42, the first peripheral region 44, the second peripheral region 46, and the wall of the internal hosel 36. FIG. 16 illustrates a horizontal cross-section further below the horizontal mid-section of the striking plate 30, which only includes the first peripheral region 44, the second peripheral region 46, and the wall of the internal hosel 36.

The striking plate 30 will also have a plurality of scorelines 75 thereon which will effect the thickness of each of the regions 40, 42, 44 and 46 at each particular scoreline. A more detailed explanation of the scorelines 75 is set forth in U.S. Pat. No. 6,443,856, entitled Contoured Scorelines For The Face Of A Golf Club, and incorporated by reference in its entirety.

As shown in FIG. 2, the striking plate 30 has a geometric center 80. The geometric center 80 is found by plotting the geometric center of the entire area of the striking plate 30. The central region 40 has a geometric center 82 that is offset from the geometric center 80 of the striking plate 30. Additionally, the thickest portion of the central region 40 is preferably at a point 84, offset from both the geometric center 80 of the striking plate and the geometric center 82 of the central region 40.

Figure 17:
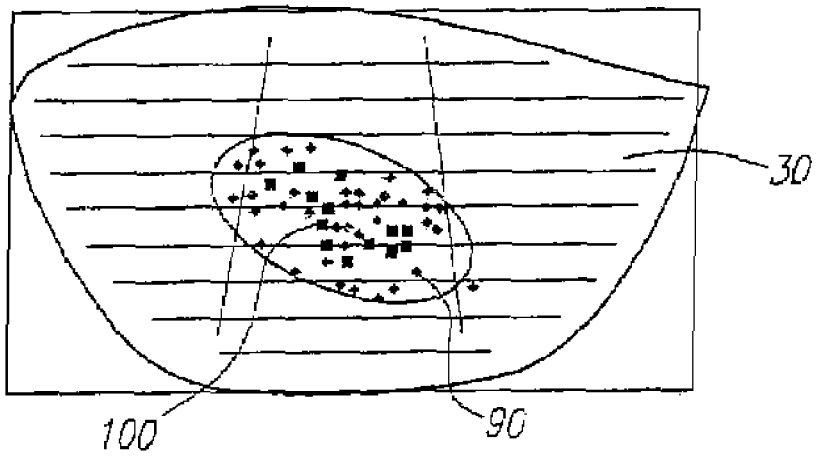
FIG. 17 is an illustration of impact probabilities for high handicap golfers.
Figure 18:
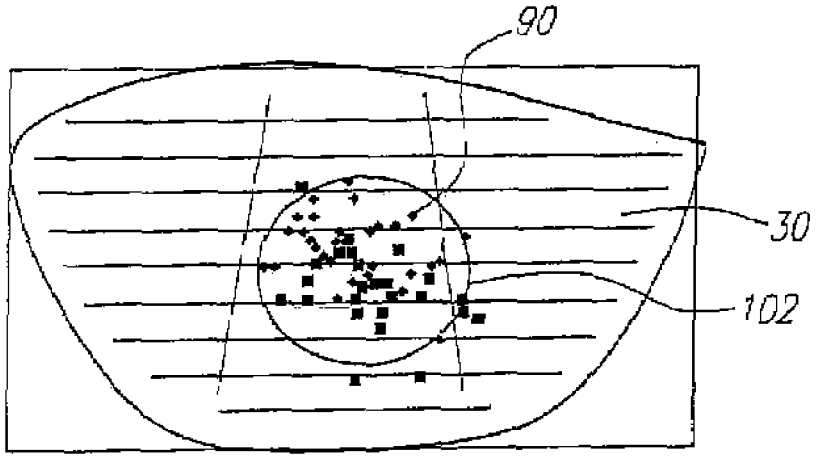
FIG. 18 is an illustration of impact probabilities for low handicap golfers.

As mentioned previously, the thickness of the regions 40, 42, 44 and 46, and for the most part, the thickness of the striking plate 30, corresponds to impact probability. FIGS. 17 and 18 illustrate the impact points during a golf swing for high handicap players and low handicap players, respectively. As shown in FIG. 17, the high handicap players had impacts 90 within an elliptical area 100 that extended through the center of the striking plate 30. In comparison, low handicap players had impacts 90 that were more concentrated and within a circular area 102 of the striking plate 30. These impacts 90 illustrate the points on a striking plate 30 that have the highest probability of undergoing the greatest stress during impact with a golf ball. Therefore, these points require greater thickness than other areas of the striking plate 30. Thus, the regions 40, 42, 44 and 46 correlate to this impact probability in order to design a striking plate with greater thickness where it is needed instead of in areas low impact probability. The present invention may be described as being thinner at the heel and toe ends 32 and 34 than the central region 40.

The variation in the thickness of the striking plate 30 also allows for the greatest thickness of regions 40, 42, 44 and 46 to be distributed in the center region 40 of the striking plate 30 thereby enhancing the flexibility of the striking plate 30 which corresponds to greater compliance of the striking plate 30 during impact with a golf ball thereby providing for reduced energy loss with allows for greater distance.

The striking plate 30 is preferably composed of a stainless steel. Alternatively, the striking plate 30 is composed of a titanium or titanium-alloy material. In yet an alternative embodiment, the striking plate 30 is composed of a vitreous metal such as iron-boron, nickel-copper, nickel-zirconium, nickel-phosphorous, and the like. Yet in further alternative embodiments, the striking plate 30 is composed of ceramics, composites or other metals.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A wood-type golf club head comprising:

a body composed of a metal material having a crown, a sole and a striking plate, the striking plate comprising a central region, a transition region and a first peripheral region, the central region having a first thickness in the range of 0.075 inch to 0.150 inch, the transition region encompassing the central region, the first peripheral region encompassing the transition region and occupying 40% to 55% of the exterior surface of a core face area, the first peripheral region having a second thickness less than the first thickness, the transition region having a thickness that transitions from the first thickness to the second thickness, wherein the core face area of the striking plate has an area of at least 4.80 square inches and wherein the golf club head has a volume greater than 300 cubic centimeters.

2. The wood-type golf club head according to claim 1 wherein the first peripheral region has a thickness in the range of 0.040 inch to 0.110 inch.

3. The wood-type golf club head according to claim 1 wherein the first peripheral region has a thickness in the range of 0.075 inch to 0.100 inch.

4. The wood-type golf club head according to claim 1 further comprising a second peripheral region encompassing the first peripheral region and having a thickness in the range of 0.010 inch to 0.085 inch.

5. A wood-type golf club head comprising:

a body composed of a metal material having a crown, a sole and a striking plate, the striking plate comprising a central region, a transition region, a first peripheral region and a second peripheral region, the central region having a first thickness and occupying 5% to 15% of the exterior surface of a core face area, the transition region encompassing the central region and occupying 35% to 50% of the exterior surface of the core face area, the first peripheral region encompassing the transition region and occupying 40% to 55% of the exterior surface of the core face area, the first peripheral region having a second thickness less than the first thickness and in the range of 0.050 inch to 0.105 inch, the transition region having a thickness that transitions from the first thickness to the second thickness, the second peripheral region encompassing the first peripheral region and having a third thickness in the range of 0.045 inch to 0.080 inch.

6. The wood-type golf club head according to claim 5 wherein the first thickness is in the range of 0.125 inch to 0.135 inch, and the second thickness is in the range of 0.085 inch to 0.095 inch.

7. The wood-type golf club head according to claim 5 wherein the metal material is a titanium alloy material.

8. The wood-type golf club head according to claim 5 wherein the metal material is a stainless steel material.

9. The wood-type golf club head according to claim 5 wherein the metal material is a vitreous metal material.

10. The wood-type golf club head according to claim 5 wherein the wood-type golf club head has a volume greater than 300 cubic centimeters.

11. A wood-type golf club head comprising:

a body composed of a titanium alloy material, the body comprising a crown, a sole and a striking plate, the striking plate comprising a central region, a first peripheral region and a second peripheral region, the central region having a first thickness in the range of 0.075 inch to 0.150 inch occupying 5% to 15% of the exterior surface of a core face area, the first peripheral region occupying 40% to 55% of the exterior surface of a core face area, the first peripheral region having a second thickness less than the first thickness, the second peripheral region having a thickness having a thickness in the range of 0.010 inch to 0.085 inch;

wherein the core face area of the striking plate has an area of at least 4.80 square inches and wherein the golf club head has a volume greater than 300 cubic centimeters.

12. The wood-type golf club head according to claim 11 wherein the central region is the thickest region of the striking plate.

13. The wood-type golf club head according to claim 11 wherein the body has a mass ranging from 180 grams to 205 grams.

14. The wood-type golf club head according to claim 11 wherein the first thickness is in the range of 0.125 inch to 0.135 inch, and the second thickness is in the range of 0.085 inch to 0.095 inch.

* * * * *